US007935759B2

(12) United States Patent
Sullivan et al.

(10) Patent No.: US 7,935,759 B2
(45) Date of Patent: May 3, 2011

(54) GOLF BALL WITH HEAT RESISTANT SHIELD LAYER

(75) Inventors: Michael J. Sullivan, Barrington, RI (US); Derek A. Ladd, Acushnet, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 404 days.

(21) Appl. No.: 12/118,860

(22) Filed: May 12, 2008

(65) Prior Publication Data

US 2009/0280927 A1 Nov. 12, 2009

(51) Int. Cl.

| | |
|---|---|
| ***A63B 37/00*** | (2006.01) |
| ***A63B 37/02*** | (2006.01) |
| ***A63B 37/04*** | (2006.01) |
| ***A63B 37/06*** | (2006.01) |

(52) U.S. Cl. ..... 525/176; 525/175; 525/221; 473/373; 473/376

(58) Field of Classification Search ..... None
See application file for complete search history.

(56) References Cited

U.S. PATENT DOCUMENTS

| | | | | |
|---|---|---|---|---|
| 5,692,974 | A | 12/1997 | Wu et al. | |
| 5,733,428 | A | 3/1998 | Calabria et al. | |
| 6,057,403 | A | 5/2000 | Sullivan et al. | |
| 6,213,895 | B1 | 4/2001 | Sullivan et al. | |
| 6,254,495 | B1 * | 7/2001 | Nakamura et al. | 473/371 |
| 6,284,840 | B1 | 9/2001 | Rajagopalan et al. | |
| 6,302,808 | B1 | 10/2001 | Dalton et al. | |
| 6,450,901 | B1 | 9/2002 | Binette et al. | |
| 6,494,795 | B2 | 12/2002 | Sullivan | |
| 6,547,677 | B2 | 4/2003 | Sullivan et al. | |
| 6,762,244 | B2 | 7/2004 | Rajagopalan et al. | |
| 6,762,247 | B2 | 7/2004 | Voorheis et al. | |
| 6,786,838 | B2 | 9/2004 | Sullivan et al. | |
| 6,815,480 | B2 | 11/2004 | Statz et al. | |
| 6,852,044 | B2 | 2/2005 | Sullivan et al. | |
| 6,981,926 | B2 | 1/2006 | Sullivan et al. | |
| 7,074,137 | B2 | 7/2006 | Sullivan et al. | |
| 7,230,045 | B2 | 6/2007 | Rajagopalan et al. | |
| 7,259,191 | B2 | 8/2007 | Sullivan et al. | |
| 7,335,114 | B2 | 2/2008 | Hebert et al. | |
| 2004/0209707 | A1 * | 10/2004 | Sullivan et al. | 473/371 |

* cited by examiner

*Primary Examiner* — David Buttner
(74) *Attorney, Agent, or Firm* — D. Michael Burns

(57) ABSTRACT

The present invention is directed to a golf ball comprising a shield layer having heat resistant properties to facilitate compression molding of a thermosetting polybutadiene-comprising layer over at least one thermoplastic layer. The invention utilizes a thermoplastic inner core comprising of a low vicat highly neutralized ionomer material having a low melting point of less than 100° C., and a Shore C surface hardness of less than 80 and a compression of less than 70, wherein a shield layer is placed around the low vicat softening point temperature thermoplastic to shield it from the high heat necessary to mold a thermoset material about it.

14 Claims, 2 Drawing Sheets

GOLF BALL WITH HEAT RESISTANT SHIELD LAYER

FIELD OF THE INVENTION

The present invention is directed to improved golf balls and, specifically to a golf ball comprised of multi-layer cores. More particularly, to where an outer core layer has heat resistant properties to facilitate compression molding of a thermosetting polybutadiene-comprising layer over at least one thermoplastic layer.

BACKGROUND OF THE INVENTION

Early solid golf balls were generally two piece balls, i.e., comprising a core and a cover. More recently developed solid balls are comprised of a core, a core layer or mantle layer, and a cover, in order to improve the playing characteristics of the ball.

The prior art is comprised of a variety of golf balls that have been designed to provide particular playing characteristics. These characteristics are generally the initial velocity and spin of the golf ball, which can be optimized for various types of players. For instance, certain players prefer a ball that has a high spin rate in order to control and stop the golf ball. Other players prefer a ball that has a low spin rate and high resiliency to maximize distance. Generally, a golf ball having a hard core and a soft cover will have a high spin rate. Conversely, a golf ball having a hard cover and a soft core will have a low spin rate. Golf balls having a hard core and a hard cover generally have very high resiliency for distance, but are hard feeling and difficult to control around the greens. Various prior art references have been directed to adding a mantle layer or second cover layer to improve the playability of solid golf balls.

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control backspin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but the lower spin will reduce the adverse effects of the side spin. Hence, recreational players prefer a golf ball that exhibits low spin rate.

There is a significant need in the industry for a ball having a large diameter but low compression core and surrounded by a harder outer core layer, i.e. a relatively large thermoplastic core with a thermoset core layer about it. As used herein, the term "thermoset" material refers to an irreversible, solid polymer that is the product of the reaction of two or more prepolymer precursor materials. However, traditionally there have been significant manufacturing difficulties when trying to compression mold a thermosetting polybutadiene-comprising layer over a thermoplastic core layer. Typical results include the melting, distortion and flow of the thermoplastic core into the surrounding rubber layer. These problems can be due to the temperature, time and pressure required to thoroughly cure the rubber. The temperatures required usually range between 315 and 350° F. which can be significantly higher than the melting temperature of the underlying thermoplastic layer. Additionally, the exotherm generated from the curing reaction of a 11-15 minute cure can elevate the rubber temperature even higher. Thus, there remains a need to minimize the temperature and/or the time that the thermoplastic material is exposed. Ball construction materials, which teach the use of a heat resistant layer, are needed to allow the compression molding of a thermoset layer over a thermoplastic layer without significant flow of the thermoplastic layer into the thermoset layer.

Other prior art golf balls have multiple core layers to provide desired playing characteristics. For example, U.S. Pat. No. 6,815,480 discloses blends of highly neutralized polymers (HNP) with hytrel and other high melt temperature materials but not discrete layers of high melt materials.

U.S. Pat. Nos. 6,057,403, 6,213,895, and 6,585,608, issued to Sullivan, disclose thermoplastic core layers but do not disclose highly neutralized polymers or the use of a heat resistant outer core layer such as disclosed in this invention.

U.S. Pat. No. 6,450,901 discloses outer covers comprising blends of very low modulus ionomers (VLMI) with a high melt ionomer (Surlyn 8549, vicat of 84° C.) having a vicat softening temp of 74° C. or more, and preferably 84° C. or more. However, no disclosure of a discrete layer of the high vicat material or of HNPs is made.

These and other objects and features of the invention will be apparent from the following summary and description of the invention, the drawings and from the claims.

SUMMARY OF THE INVENTION

The present invention is directed to an improved golf ball comprised of an inner core and multiple layers surrounded the inner core to improve the playing characteristics of the golf ball. At least the inner core or one of the multiple layers is a low melting point thermoplastic material and an outer adjacent layer (shield layer) is a high melting point thermoplastic material. This combination facilitates the compression molding of a thermosetting polybutadiene-comprising layer over a thermoplastic layer.

The invention provides constructions and methods of molding such that allows for a cross-linked polybutadiene composition (conventional inner core formulations) as the shield layer which is molded over a high resilience thermoplastic core material such as highly neutralized ionomers to minimize the "leakage" of the inner core material out of the mold equator as the outer core layer cures.

An embodiment of the invention provides for a golf ball comprising a thermoplastic inner core of a partially or fully neutralized ionomer having a first vicat softening point temperature of 75° C. or less, the inner core having a surface hardness of less than 85 Shore C and a compression of less than 80. A shield layer encasing the inner core comprises a thermoplastic material having a second vicat softening point temperature of at least 20° C. greater than the first, preferably 50° C. greater, and more preferably 100° C. greater.

Another embodiment of the invention provides for a golf ball having an inner core comprising a thermoset polybutadiene composition having a first hardness; an intermediate core layer comprising a partially or fully neutralized ionomer having a first vicat softening point temperature of 75° C. or less and having a second hardness; a shield layer encasing the intermediate core layer comprising a thermoplastic material having a second vicat softening temperature of at least 20° C. greater than the first, preferably at least 50° C. greater and more preferably at least 100° C. greater, and the shield layer having a third hardness; and an outermost core layer comprising a thermoset polybutadiene composition having a fourth hardness. The first hardness is less than the second hardness, the second hardness is less than the third hardness, and the fourth hardness is less than the third hardness.

DESCRIPTION OF THE PREFERRED EMBODIMENTS

Figure 1:
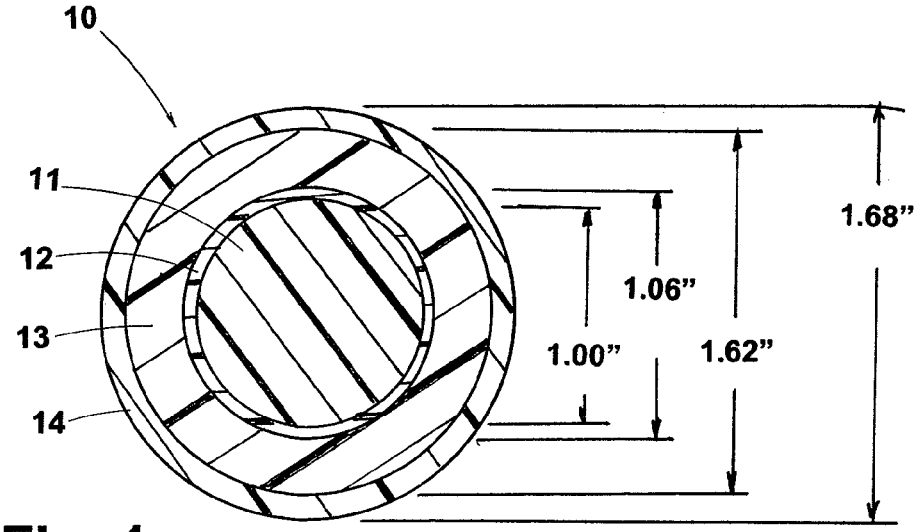
FIG. 1 is a cross-sectional view of a golf ball formed according to the present invention having a partially or fully neutralized ionomer center comprising: three outer layers: a shield layer; an outer core layer comprising a peroxide cross-linked polybutadiene; and a polymer cover layer.

The present invention is directed to a multi-piece golf ball comprising two or more core layers in which at least one layer is a low melting point thermoplastic material and an adjacent outer core layer is a high melting point thermoplastic material, preferably a heat resistant layer. This combination facilitates compression molding of a thermosetting polybutadiene comprising layer over the thermoplastic layers and the present invention successfully performs this construction without the thermoplastic material bleeding into the thermoset material.

The thermoset material is typically formed from a castable reactive liquid material. The preferred materials for this layer include, but are not limited to thermoset urethanes and polyurethanes, thermoset urethane ionomers and thermoset ureas. Examples of suitable poly-urethane ionomers are disclosed in U.S. Pat. No. 5,692,974, filed Jun. 7, 1995, the disclosure of which is hereby incorporated by reference in its entirety in the present application. Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as N,N,N,N-tetrakis(2-hydroxpropyl)ethylendiamine. However, the present invention is not limited to just these specific types of thermoset polyurethanes.

The invention provides constructions and methods of molding that allow for a cross-linked polybutadiene composition (normally what makes up the inner core formulations) as an outer core or outermost core layer molded over high resilience thermoplastic core materials such as highly neutralized ionomers. The use of high melting point or high vicat softening point material provides for easier over-molding of a thermo-plastic composition (such as a polybutadiene core formulation) and minimizes the "leakage" of inner core material out of the mold equator as the outer core layer cures.

For the purposes of this invention, high vicat is defined as at least 80° C., preferably at least 90° C., and most preferably at least 100° C. and includes straight materials as well as blends of two or more materials, said blend having a vicat of at least 80° C. Included herein are blends of a low vicat and a high Vicat, as long as the blend composition has a vicat of over 80° C. For example, a high vicat could include a blend of an highly neutralized polymer (HNP) such as a HNP 2000 (vicat of 54° C.) and a Hytrel 4069 (vicat of 134° C.). Another example of a high vicat material is Surlyn SG201U which is a Surlyn/polyester alloy having a vicat of 190° C. Such ionomer resins and the manner in which they are made is well known in the art as described in U.S. Pat. No. 3,262,272. Such ionomer resins are commercially available from DuPont Co. under the tradename SURLYN® and from Exxon under the tradename Iotek®. Some particularly suitable SURLYNS® include SURLYN® 8549, SURLYN® 8610, SURLYN® 8940, SURLYN® 8527, and SURLYN® 8660. A suitable ionomer from Exxon include IOTEK® 8000.

These grades of ionomers have low (under 80° C.) vicat softening points, with the exception of Surlyn 8549.

PHYSICAL PROPERTY COMPARISON

| Physical Property | Surlyn 8549 | Surlyn 8610 | Iotek 8000 | Surlyn 8940 | Surlyn 8527 | Surlyn 8660 |
|---|---|---|---|---|---|---|
| Melt Index (g/10 min) | 2.3 | 1.3 | 0.8 | 2.8 | 1 | 10 |
| Melt temperature (° C.) | 100 | 86 | 83 | 94 | 93 | 95 |
| Vicat softening (° C.) | 84 | 57 | 54 | 63 | 73 | 71 |
| Tensile strength (MPa) | 32 | 34 | 33 | 33 | 29 | 23.4 |
| Elongation (%) | 300 | 420 | 370 | 470 | 450 | 470 |
| Flex modulus (MPa) | 390 | 290 | 320 | 350 | 220 | 230 |
| Haze (%) | 4 | 5 | 5 | 5 | 6 | 11 |
| Shore D | 61 | 58 | 60 | 65 | 0 | 62 |

PHYSICAL PROPERTY COMPARISON FOR HYTREL ® Grades

| Physical Property | Hytrel ® 3078 | Hytrel ® 4069 | Hytrel ® 5556 | Hytrel ® 6356 | Hytrel ® 7246 |
|---|---|---|---|---|---|
| Melt Index (g/10 min) | 5.0 190° C. | 8.5 @220° C. | 7.5 @220° C. | 8.5 @230° C. | 12.5 @240° C. |
| Melt temperature (° C.) | 170 | 193 | 203 | 211 | 218 |
| Vicat softening (° C.) | 83 | 134 | 180 | 195 | 207 |
| Tensile strength (Mpa) | 26.2 | 27.6 | 40 | 41 | 45.8 |

-continued

PHYSICAL PROPERTY COMPARISON FOR HYTREL ® Grades

| Physical Property | Hytrel ® 3078 | Hytrel ® 4069 | Hytrel ® 5556 | Hytrel ® 6356 | Hytrel ® 7246 |
|---|---|---|---|---|---|
| Elongation (%) | 700 | 600 | 500 | 420 | 360 |
| Flex. Modulus (Mpa) | 28 | 55 | 207 | 330 | 570 |
| Hardness (Shore D) | 30 | 40 | 55 | 63 | 72 |

Hytrel ® is a block copolymer of polyether-ester from Du Pont.

PHYSICAL PROPERTY COMPARISON FOR Pebax ® Grades

| Physical Property | Pebax ® 2533 | Pebax ® 3533 | Pebax ® 4033 | Pebax ® 5533 | Pebax ® 6333 | Pebax ® 7033 |
|---|---|---|---|---|---|---|
| Melt Volume flow rate (cm3/10 min) at 235 C. (ISO 1133) | 14.0 | 12.0 | 9.0 | 8.0 | 8.0 | 6.0 |
| Melt temperature (° C.) | 148 | 152 | 168 | 168 | 172 | 174 |
| Vicat softening(° C.) | 60 | 74 | 132 | 144 | 161 | 165 |
| Tensile strength (Mpa) | 34.1 | 38.6 | 39.3 | 50.3 | 55.9 | 57.2 |
| Flex. Modulus (Mpa) | 15 | 19.3 | 90 | 200 | 338 | 462 |
| Hardness (Shore D) | 25 | 35 | 40 | 55 | 63 | 69 |

Pebax ® is a block copolymer of polyether-amide from Arkema.

PHYSICAL PROPERTY COMPARISON FOR Estane ® Grades

| Physical Property | Estane ® 58280 | Estane ® 58810 | Estane ® 58092 | Estane ® 58130 | Estane ® 58137 | Estane ® 58091 |
|---|---|---|---|---|---|---|
| Melt temperature (° C.) | NA | NA | NA | 220 | 228 | 223 |
| Tensile strength (Mpa) | 24.9 | 37.9 | 31.7 | 38.6 | 37.2 | 29.0 |
| Elongation (%) | 750 | 525 | 450 | 530 | 430 | 160 |
| Flexural modulus (Mpa) | 16.2 | 37.7 | NA | NA | NA | NA |
| Vicat Softening (° C.) | 66 | 110 | NA | NA | NA | NA |
| Hardness (Shore D) | 27 | 42 | 45 | 50 | 67 | 70 |

Estane ® is a thermoplastic urethane either ether or ester urethane type from Lubrizol Inc.

PHYSICAL PROPERTY COMPARISON

| Physical Property | Rilsan ® AMNO | Rilsan ® BMNO | Xylex ® X7110 | Xylex ® X7300 | Xylex ® X8300 |
|---|---|---|---|---|---|
| Melt Flow Index (9/10 min) at 265 C. | NA | NA | 9.0 | 21 | 15 |
| Melt temperature (° C.) | 174 | 189 | NA | NA | NA |

-continued

PHYSICAL PROPERTY COMPARISON

| Physical Property | Rilsan ® AMNO | Rilsan ® BMNO | Xylex ® X7110 | Xylex ® X7300 | Xylex ® X8300 |
|---|---|---|---|---|---|
| Vicat softening(° C.) | NA | NA | 106 | 108 | 96 |
| Tensile strength (Mpa) | 65.5 | 68.9 | 48.3 | 52.0 | 46 |
| Elongation (%) | 400 | 390 | 150 | 150 | 150 |
| Flex. Modulus (Mpa) | 1100 | 1100 | 1750 | 2000 | 1680 |
| Hardness (Rockwell-R scale) | 106 | 108 | NA | NA | NA |

Rilsan ® AMNO is Polyamide 12 from Arkema;
Rilsan ® BMNO Polyamide 11 from Arkema.
Xylex ® is polycarbonate/polyester blend from Sabic Innovative Plastics Highly neutralized ionomers (HNP), such as HPF 1000 and HPF 2000 (both manufactured by DuPont), have vicats of 59° C. and 54° C. respectively. While the HPFs have very cross-linked PBR-like properties of high coefficient of restitution (COR) and relatively soft compressions as molded spheres (versus other Surlyn grades) which makes them good candidates for core materials, however, their low melting points make them difficult to compression mold over when using a preferred polybutadiene composition. The present invention teaches a successful method for making a ball having a low vicat HNP inner core surrounded by a compression molded polybutadiene composition. Typically, during the compression molding of this type of outer core, the inner core melts and has a tendency to flow out at the mold equator, giving a core that has poor durability and inconsistent properties. The present invention has solved this problem by adding a heat resistant layer (a shield layer) comprising of a high melt material disposed between the low vicat softening point temperature HNP inner core and the high vicat softening point temperature PBR outer core layer, thereby effectively provided a shield for the HNP core against the heat used/generated to cure the polybutadiene outer core. The high melt thermoplastic is preferably injection molded around the HNP inner core. By using the high vicat intermediate layer, the HNP inner core does not get exposed to enough temperature/time to melt the HNP or induce flow of the HNP.

Preferred high melt thermoplastics materials that are used in the shield layer 12 of FIG. 1, and described below, are polyetheramides (Pebax®, which is available from Elf-Atochem), and polyetheresters which include materials which are commercially available from DuPont under the tradename Hytrel®, polyester-amides, thermoplastic urethanes, polyesters such as polybutylene terephthalate (PBT) or polyethylene terephthalate (PET) or copolymers thereof, polycarbonates, polyamides, polypropylene, polyethylene, thermoplastic vulcanizates (TPVs) and any disclosed in such U.S. patents as U.S. Pat. Nos. 6,762,244, 6,284,840 and 6,302,808, the disclosures of which are hereby incorporated by reference in their entirety in the present application. The vicat softening temperature for high density polyethylene (HDPE) is about 128° C.; for polypropylene 153° C., Nylon 66 about 261° C., a Surlyn/polyester alloy sold by DuPont as Surlyn Supergloss G201U has a vicat of 190° C. Hytrel® grades have a range of about 83-207° C. and Pebax® resins have a range of 74 to 165° C. Blends or alloys of any of these materials with any low melt materials such as Surlyn or HNPs may also be employed. Vicat temperature is measured per ASTM D1525.

Another embodiment of the invention is to use blends of HNP with high vicat materials, such as Hytrel® to raise the vicat of the HNP-comprising core to an acceptable level thereby eliminating the need for an outer layer of high vicat material.

The melting and flow of thermoplastic layers in these types of constructions is primarily due to the temperature, time and pressure required to thoroughly cure the rubber. The temperatures that are typically used range between 315-350° F. which can be significantly higher than the melting temperature of the underlying thermoplastic layer.

When golf balls are prepared according to the invention, they typically will have dimple coverage greater than about 60 percent, preferably greater than about 65 percent, and more preferably greater than about 75 percent. The flexural modulus of the cover material used on the golf balls, as measured by ASTM method D6272 98, Procedure B, is typically greater than about 10 kpsi, and is preferably from about 10 kpsi to 150 kpsi, more preferably 15 to 70 kpsi. As discussed herein, the outer cover layer is preferably formed from a relatively soft ionomer, poly-urethane, or polyurea material. In particular, the material of the outer cover layer should have a material hardness, as measured by ASTM-D2240, less than about 70 Shore D, more preferably between about 25 and about 50 Shore D, and most preferably between about 40 and about 48 Shore D. An intermediate core layer preferably has a material hardness of less than about 70 Shore D, more preferably less than 65 Shore D, and most preferably, between about 25 and 65 Shore D.

The overall outer diameter ("OD") of the thermoplastic inner core is less than about 1.650 inches, preferably, no greater than 1.620 inches, more preferably between about 1.000 and about 1.510 inches, and most preferably less than 1.50 inches. The outside diameter of the intermediate core layer is preferably between 1.580 inches and about 1.650 inches, more preferably between about 1.590 inches to about 1.630 inches, and most preferably between about 1.600 inches to about 1.630 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

The cover layer typically has a thickness to provide sufficient strength, good performance characteristics, and durability. The thickness of the cover layer may be from about 0.005 inches to about 0.100 inches, preferably about 0.007 inches to about 0.035 inches. In one embodiment, the cover layer thickness is from about 0.02 inches to about 0.35 inches. In another embodiment, the cover preferably has a thickness of about 0.02 inches to about 0.12 inches, preferably about 0.1 inches or less, more preferably about 0.07 inches or less. In yet another embodiment, the outer cover has a thickness from about 0.02 inches to about 0.07 inches. In still another embodiment, the cover thickness is about 0.05 inches or less, preferably from about 0.02 inches to about 0.05 inches. For example, the cover layer may be between about 0.02 inches and about 0.045 inches, preferably about 0.025 inches to about 0.04 inches thick. In one embodiment, the outer cover layer is about 0.03 inches thick.

The range of thicknesses for a shield layer of a golf ball is large because of the vast possibilities when using a shield layer, i.e., as an outer core layer, an inner cover layer, a wound layer, a moisture/vapor barrier layer. When used in a golf ball of the invention, the shield layer, or inner cover layer, may have a thickness about 0.3 inches or less. In one embodiment, the thickness of the shield layer is from about 0.002 inches to about 0.1 inches, preferably about 0.01 inches or greater. In one embodiment, the thickness of the shield layer is about 0.09 inches or less, preferably about 0.06 inches or less. In another embodiment, the shield layer thickness is about 0.05 inches or less, more preferably about 0.01 inches to about 0.045 inches. In one embodiment, the shield layer, thickness is about 0.02 inches to about 0.04 inches. In another embodiment, the shield layer thickness is from about 0.025 inches to about 0.035 inches. In yet another embodiment, the thickness of the shield layer is about 0.035 inches thick. In still another embodiment, the inner cover layer is from about 0.03 inches to about 0.035 inches thick. Varying combinations of these ranges of thickness for the shield and outer cover layers may be used in combination with other embodiments described herein.

The ratio of the thickness of the shield layer to the outer cover layer is preferably about 10 or less, preferably from about 3 or less. In another embodiment, the ratio of the thickness of the shield layer to the outer cover layer is about 1 or less.

Accordingly, it is preferable that the golf balls of the present invention have a shield layer with a flexural modulus of about 500 psi to about 500,000 psi according to ASTM D-6272-98. More preferably, the flexural modulus of the shield layer is about 1,000 psi to about 250,000 psi. Most preferably, the flexural modulus of the shield layer is about 2,000 psi to about 200,000 psi. The flexural modulus of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural modulus of the cover layer is about 100,000 psi or less, preferably about 80,000 or less, and more preferably about 70,000 psi or less. For example, the flexural modulus of the cover layer may be from about 10,000 psi to about 70,000 psi, from about 12,000 psi to about 60,000 psi, or from about 14,000 psi to about 50,000 psi.

In one embodiment, when the cover layer has a hardness of about 50 Shore D to about 67 Shore D, the cover layer preferably has a flexural modulus of about 55,000 psi to about 70,000 psi.

In one embodiment, the ratio of the flexural modulus of the shield layer to the cover layer is about 0.003 to about 50. In another embodiment, the ratio of the flexural modulus of the shield layer to the cover layer is about 0.006 to about 4.5. In yet another embodiment, the ratio of the flexural modulus of the shield layer to the cover layer is about 0.11 to about 4.5.

In one embodiment, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

The specific gravity of a cover or shield layer is preferably at least about 0.7. In one embodiment, the specific gravity of the shield layer or cover is about 0.8 or greater, preferably about 0.9 or greater. For example, in one embodiment, the golf ball has a shield layer with a specific gravity of about 0.9 or greater and a cover having a specific gravity of about 0.95 or greater. In another embodiment, the shield layer or cover has a specific gravity of about 1.00 or greater. In yet another embodiment, the specific gravity of the shield layer or cover is about 1.05 or greater, preferably about 1.10 or greater. In still another embodiment, the specific gravity of the shield layer or cover is about 1.0 to about 1.3.

The core may have a specific gravity of about 1.00 or greater, preferably 1.05 or greater. For example, a golf ball of the invention may have a core with a specific gravity of about 1.10 or greater and a cover with a specific gravity of about 0.95 or greater.

Although the United States Golf Association ("USGA") specifications limit the minimum size of a competition golf ball to 1.680 inches. There is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

As used herein, the term "about," used in connection with one or more numbers or numerical ranges, should be understood to refer to all such numbers, including all numbers in a range.

The overall outer diameter (OD) of the core (including the center and any intermediate layers, the outer core layer or windings) together with the inner cover layer of the golf balls of the present invention is about 1.58 inches to about 1.64 inches, preferably about 1.60 inches to about 1.63 inches, more preferably about 1.62 inches to about 1.63 inches and most preferably about 1.62 inches. The outer diameter of the center of the core is about 1.00 inches to about 1.60 inches. In another embodiment, the outer diameter of the core (including the center and any intermediate mantle layer(s) or windings) without the inner cover layer is about 1.5 inches to about 1.6 inches, preferably about 1.55 inches to about 1.58 inches.

The present multilayer golf ball can have an overall diameter of any size. Although the United States Golf Association (USGA) specifications limit the minimum size of a competition golf ball to more than 1.680 inches in diameter, there is no specification as to the maximum diameter. Moreover, golf balls of any size can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

The cores and inner cover of the golf balls of the present invention can be made by any conventional process employed in the golf ball art. For example, the solid centers can be either injection or compression molded. Similarly, the wound centers employed in the present invention can be produced through conventional means. The inner cover layer and any mantle or outer core layer(s) are subsequently injection or compression molded about the core.

However, due to the very thin thickness (less than 0.05"), it is not practical to form the cover layers of the ball using conventional injection or compression molding techniques ordinarily employed in the golf ball art for applying cover materials. These conventional ball molding processes are not capable of easily applying such thin outer cover layers over a solid spherical surface. Accordingly, it has been found that the use of a castable, reactive material which is applied in a fluid form makes it possible to obtain very thin outer cover layers on golf balls. Specifically, it has been found that castable, reactive liquids which react to form a thermoset material provide desirable very thin outer cover layers.

The castable, reactive liquid employed to form the thermoset material can be applied over the inner core using a variety of application techniques such as spraying, dipping, spin coating or flow coating methods which are well known in the art. An example of a suitable coating technique is that which is disclosed in U.S. Pat. No. 5,733,428, filed May 2, 1995 entitled "Method And Apparatus For Forming Polyurethane Cover On A Golf Ball", the disclosure of which is hereby incorporated by reference in its entirety in the present application. Similarly, U.S. Pat. No. 5,006,297 to Brown et al. and U.S. Pat. No. 5,334,673 to Wu both disclose suitable coating techniques which may be utilized to apply the castable reactive liquids employed in the present invention. The disclosures of these patents are hereby incorporated by reference in their entirety. However, the method of the invention is not limited to the use of these techniques.

EXAMPLES

The following examples are provided only for the purpose of illustrating the invention and are not to be construed as limiting the invention in any manner.

Prophetic Example 1

A golf ball 10, as shown in FIG. 1, has a 1.00 inch thermoplastic inner core 11 formed from HNP 2000 material (DuPont) which has a low vicat and a low melting point of less than 100° C., preferably a maximum of 75° C., and a Shore C surface hardness of less than 85 and a compression of less than 80; and a shield layer 12 of about 0.030 inch thick of Hytrel 4069 (DuPont), which is a high vicat thermoplastic composition having a vicat of at least 134° C. and a Shore D hardness of less than 65; a thermoset outer core layer 13 comprising of a peroxide cross-linked polybutadiene composition having a thickness of about 0.280 inch, a Shore C hardness of at least 80 and a specific gravity of greater than or equal to the shield layer 12; and, an ionomer, polyurethane or polyurea cover layer 14 having a thickness of about 0.030 inch, the cover layer 14 being either cast or reaction injection molded. The thermoset shield layer 12 has a vicat softening point temperature of at least 20° C. greater than the vicat softening point temperature of the thermoplastic inner core 11, and preferably at least 50 C greater, and more preferably at least 100° C. greater.

Prophetic Example 2

Figure 2:
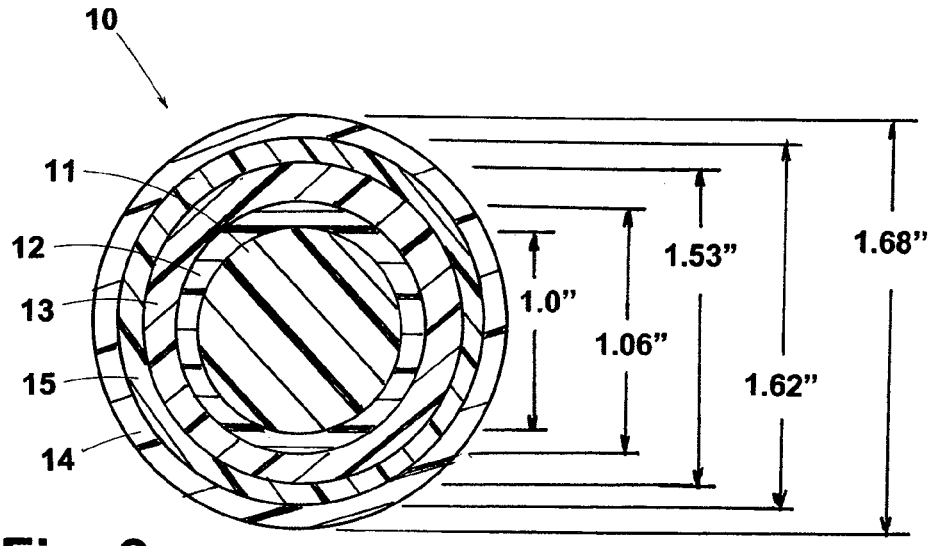
FIG. 2 is a cross-sectional view of a five piece golf ball formed according to FIG. 1 but further including an inner cover layer disposed between the outer core and cover layers.

As seen in FIG. 2, this example is the same as Example 1, except the ball further includes a thin inner cover layer 15 of Surlyn 7940, which is cast over the outer core layer 13. The thickness of the inner cover layer 15 is about 0.045 inch or less, and the outer core layer 13 is subsequently reduced by 0.02 inch. Surlyn 7940 comprises an ethylene/methacrylic acid copolymer in which the methacrylic acid groups have been partially neutralized with lithium ions and the vicat softening point is 63° C.

Prophetic Example 3

Figure 3:
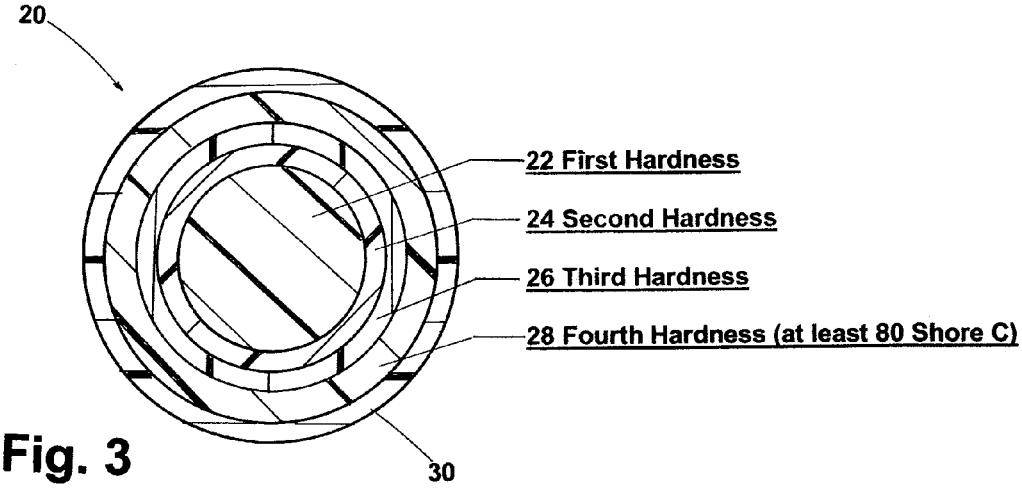
FIG. 3 is a cross-sectional view of a five piece golf ball as described in Prophetic Example 3.

Another embodiment of the invention is depicted in FIG. 3. A ball 20 includes an inner core 22 comprising of a thermoset polybutadiene composition and having a vicat of about 75° C. or less and having a first hardness. Encasing the inner core 22 is an intermediate layer 24 having a second hardness and comprising a partially or fully neutralized ionomer having a low vicat softening temperature. Surrounding the intermediate core layer 24 is a shield layer 26 comprising a thermoplastic material having a high vicat softening temperature of at least 80° C. and preferably 100° C., and the outer core layer having a third hardness. An outermost core layer 28 disposed over the shield layer 26 and comprising a thermoset polybutadiene composition having a fourth hardness of at least 80 Shore C and a specific gravity of at least 1.20 g/cc. The ball 20 has a cover layer 30 disposed over the outermost core layer 28. Not shown but the cover layer 30 may further be comprised of inner and outer cover layers, wherein the inner cover layer has a thickness of 0.045 inch or less and the outer cover layer has a thickness of 0.035 inch or less.

The core layers can be made of thermoplastic elastomers including dynamically vulcanized thermoplastic elastomers and blends thereof. Suitable dynamically vulcanized thermoplastic elastomers include Santoprene®. Sarlink®, Vyram®, Dytron® and Vistaflex®. Santoprene® is the trademark for a dynamically vulcanized PP/EPDM. Santoprene® 203-40 is an example of a preferred Santoprene® and is commercially available from Advanced Elastomer Systems.

Examples of suitable functionalized styrene-butadiene elastomers include Kraton FG-1901x and FG-1921x, available from the Shell Corporation. Examples of suitable thermoplastic polyurethanes include Estane® 58133, Estane® 58134 and Estane® 58144, which are available from the B.F. Goodrich Company. Further, the materials may be in the form of a foamed polymeric material. For example, suitable metallocene polymers include foams of thermoplastic elastomers based on metallocene single-site catalyst-based foams. Such metallocene-based foams are commercially available from Sentinel Products of Hyannis, Mass.

Suitable thermoplastic polyetheresters include Hytrel® 3078, Hytrel® G3548W, and Hytrel® G4078W which are commercially available from DuPont. Suitable thermoplastic polyetheramides include Pebax® 2533, Pebax® 1205 and Pebax® 4033 which are available from Elf-Atochem. Suitable thermoplastic polyesters include polybutylene terephthalate.

Suitable thermoplastic ionomer resins are obtained by providing a cross metallic bond to polymers of mono-olefin with at least one member selected from the group consisting of unsaturated mono- or di-carboxylic acids having 3 to 12 carbon atoms and esters thereof. The polymer contains 1 to 50% by weight of the unsaturated mono- or di-carboxylic acid and/or ester thereof. More particularly, low modulus ionomers, such as acid-containing ethylene copolymer ionomers, include E/X/Y copolymers where E is ethylene, X is a softening comonomer such as acrylate or methacrylate present in 0-50 (preferably 0-25, most preferably 0-2), weight percent of the polymer, and Y is acrylic or methacrylic acid present in 5-35 (preferably 10-35, most preferably 15-35, making the ionomer a high acid ionomer) weight percent of the polymer, wherein the acid moiety is neutralized 1-100% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth) acrylic acid/ethyl acrylate, and ethylene/(meth)acrylic acid/methyl acrylate copolymers.

Thermoplastic blends comprise about 1% to about 99% by weight of a first thermoplastic and about 99% to about 1% by weight of a second thermoplastic. Preferably the thermoplastic blend comprises about 5% to about 95% by weight of a first thermoplastic and about 5% to about 95% by weight of a second thermoplastic. In a preferred embodiment of the present invention, the first thermoplastic material of the blend is a dynamically vulcanized thermoplastic elastomer, such as Santoprene®.

Fillers typically include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, and the like. Fillers may be added to one or more portions of the golf ball and typically may include processing aids or compounds to affect rheological and mixing properties, density-modifying fillers, fillers to improve tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

The invention also includes, if desired, a method to convert the cis-isomer of the polybutadiene resilient polymer component to the trans-isomer during a molding cycle and to form a golf ball. A variety of methods and materials suitable for cis-to-trans conversion have been disclosed in U.S. Pat. No. 6,162,135 and U.S. application Ser. No. 09/461,736, filed Dec. 16, 1999; Ser. No. 09/458,676, filed Dec. 10, 1999; and Ser. No. 09/461,421, filed Dec. 16, 1999, each of which are incorporated herein, in their entirety, by reference.

The materials used in forming either the golf ball center or any portion of the core, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder.

Conventional mixing speeds for combining polymers are typically used. The mixing temperature depends upon the type of polymer components, and more importantly, on the type of free-radical initiator. Suitable mixing speeds and temperatures are well-known to those of ordinary skill in the art, or may be readily determined without undue experimentation.

The mixture can be subjected to, e.g., a compression or injection molding process, to obtain solid spheres for the center or hemispherical shells for forming an intermediate layer. The temperature and duration of the molding cycle are selected based upon reactivity of the mixture. The molding cycle may have a single step of molding the mixture at a one particular temperature for a fixed duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. The materials used in forming either the golf ball center or any portion of the core, may be combined to form a golf ball by an injection molding process, which is also well-known to one of ordinary skill in the art. Although the curing time depends on the various materials selected, those of ordinary skill in the art will be readily able to adjust the curing time upward or downward based on the particular materials used and the discussion herein.

The properties such as hardness, Bayshore resilience modulus, center diameter and layer thickness of the golf balls of the present invention have been found to affect play characteristics such as spin, initial velocity and feel of golf balls.

The golf ball of the present invention can have an overall diameter of any size. Although the United States Golf Association (USGA) specifications limit the minimum size of a competition golf ball to more than 1.680 inches in diameter, there is no specification as to the maximum diameter. Moreover, golf balls of any size can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

While it is apparent that the illustrative embodiments of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

What is claimed is:

1. A golf ball comprising:

a thermoplastic inner core comprising: a partially or fully neutralized ionomer, and including either dynamically vulcanized thermoplastic elastomers; or suitable functionalized styrene-butadiene elastomers; or thermoplastic polyetheresters or; polyetheramides; or thermoplastic polyesters; or mixtures thereof, having a first vicat softening point temperature, the inner core having a surface hardness of less than 85 Shore C and a compression of less than 80;

a shield layer encasing the inner core comprising a thermoplastic material having a second vicat softening point temperature of at least 20° C. greater than the first;

an outer core layer disposed about the shield layer and comprising a thermoset diene rubber composition; and a cover layer.

2. The golf ball according to claim 1, wherein the first vicat softening point temperature is 75° C. or less.

3. The golf ball according to claim 2, wherein the second vicat softening point temperature is at least 50° C. greater than the first.

4. The golf ball according to claim 2, wherein the second vicat softening point temperature is at least 100° C. greater than the first.

5. The golf ball according to claim 1, wherein the thermoplastic inner core has a diameter of about 1.50 inches or less.

6. The golf ball according to claim 1, wherein the thermoplastic inner core has a diameter of about 1.00 inches or less.

7. The golf ball according to claim 1, wherein the shield layer has a thickness of 0.050 inch or less.

8. The golf ball according to claim 7, wherein the shield layer has a thickness of 0.030 inch or less.

9. The golf ball according to claim 8, wherein the shield layer material has a Shore D hardness of 65 or less.

10. The golf ball according to claim 9, wherein the shield layer comprises polyetheramides; polyetheresters; polyesteramides; thermoplastic urethanes; polyesters; polycarbonates; polyamides; polypropylene; polyethylene; or mixtures thereof.

11. The golf ball according to claim 1, wherein the outer core layer comprises a peroxide cross-linked polybutadiene composition.

12. The golf ball according to claim 1, wherein the cover layer comprises an ionomer, a polyurethane or a polyurea.

13. The golf ball according to claim 12, wherein the polyurethane or the polyurea is a castable or reaction injection moldable thermosetting composition.

14. A golf ball according to claim 1, wherein the cover layer comprises an inner and an outer layer, wherein the inner layer has a thickness of 0.045 inch or less and the outer cover layer has a thickness of 0.035 inch or less.

* * * * *